US005277550A

United States Patent [19]

Kato et al.

[11] Patent Number: 5,277,550

[45] Date of Patent: Jan. 11, 1994

[54] AGITATING VANE

[75] Inventors: Kohichi Kato, Warabi; Shigeru Nishioka, Tokyo, both of Japan

[73] Assignee: Satake Chemikal Equipment Mfg., Ltd., Moriguchi, Japan

[21] Appl. No.: 905,315

[22] Filed: Jun. 29, 1992

[30] Foreign Application Priority Data

Oct. 17, 1991 [JP] Japan ..... 3-298551
Oct. 17, 1991 [JP] Japan ..... 3-298552

[51] Int. Cl.[5] ..... B01F 7/20; B01F 7/32

[52] U.S. Cl. ..... 416/227 R; 416/231 A; 416/231 B; 416/194

[58] Field of Search ..... 416/227

[56] References Cited

U.S. PATENT DOCUMENTS 37,357 1/1863 Palmer et al. ..... 416/227
1,344,496 6/1920 Flattum ..... 416/227 A
1,742,792 1/1930 Stahl ..... 416/227 A
2,103,243 12/1937 Bradford, Jr. ..... 416/227 A
4,015,911 4/1977 Darvishian ..... 416/231 B
4,545,726 10/1985 Holliger ..... 416/227 A

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

A plurality of flat plates are laterally disposed at an outer circumference of a hub and auxiliary vanes are disposed in parallel to at least side edges of each of said flat plates while being spaced apart from the side edges. Accordingly, an occurrence of eddy flows can be restricted, a peeling-off eddy flow can be reduced, agitating and mixing of gas-liquid can be made efficient without producing any damage to microorganisms or the like and an agitating efficiency can be improved with a simple structure.

4 Claims, 5 Drawing Sheets

AGITATING VANE

BACKGROUND OF THE INVENTION

1. Field of the Invention:

This invention relates to agitating vanes of an agitating device for agitating and mixing liquid or gas contained in a container in food processing industries and chemical industries or the like.

2. Description of the Related Art:

Conventional vanes are provided as flat plates laterally disposed in a predetermined angular spacing at an outer circumference of a rotary shaft or single-plated belt-like vanes radially projected at a hub of the rotary shaft and slanted in a rotational direction of the rotary shaft.

This known agitating vane had problems in that eddy currents or flows are generated at the rear portions of the circumferences of the flat plates during rotation of the rotary shaft and a shearing force may act against the liquid to damage microorganisms in the liquid due to breakage of air bubbles caused by the eddy, flows. In addition, the agitating vane had problems in that eddy flows are generated at the upper surfaces of the rear ends of the single-plated vanes in a rotational direction during rotation of the agitating vanes as a result of which the liquid is peeled off along with the eddy flows, a circulating speed of the liquid is decreased due to such peeling-off and the agitating efficiency is decreased.

SUMMARY OF THE INVENTION

It is an object of the present invention to reduce an occurrence of eddy flows, reduce peeled-off eddy flows and provide an efficient agitating and mixing of gas-liquid without damaging microorganisms or the like.

It is another object of the present invention to increase agitating efficiency with a simple structure.

In order to achieve these objects, the present invention provides a plurality of flat plates which are laterally disposed at an outer circumference of the hub and several auxiliary vanes are mounted at side edges of each of the flat plates, in parallel with the side edges and in spaced-apart relation therefrom.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
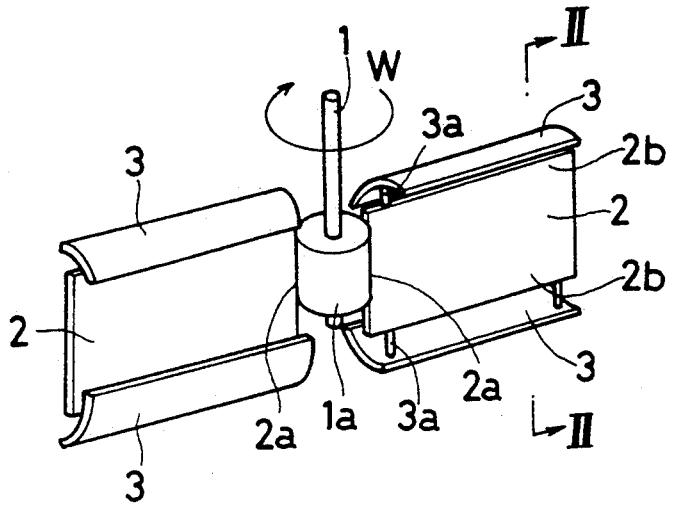
FIG. 1 is a perspective view showing the first preferred embodiment of the present invention.
Figure 2:
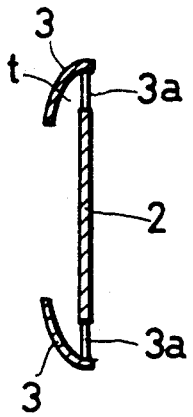
FIG. 2 is a sectional view taken along a line II—II of FIG. 1.
Figure 3:
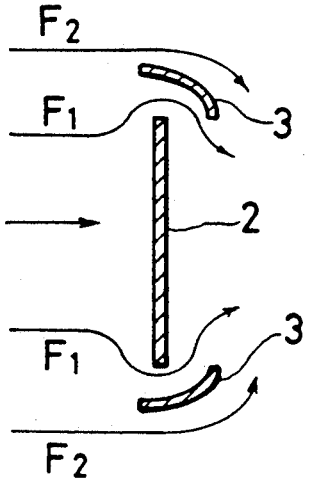
FIG. 3 is an illustrative view showing a state of flow.

Referring now to FIGS. 1 to 3, the first preferred embodiment of the present invention will be described.

Reference numeral 1 denotes a rotary shaft. To the rotary shaft is fixed a hub 1*a* and the rotary shaft 1 is rotated in the direction of rotation shown by an arrow W. Reference numerals 2 denote flat plates. The flat plates 2 are fixed symmetrically in respect to the hub 1*a* at their inner sides 2*a* so that major surfaces of the flat plates extend substantially perpendicular to the direction of rotation. Reference numerals 3...3 denote auxiliary vanes. The auxiliary vanes 3 are comprised of gutter-like plates having a substantially arcuate shape in section and having lengths equal to the upper and lower sides 2*b* of the flat plates 2. The auxiliary vanes have a clearance (t) with respect to the side edges of the flat plates 2, i.e., the upper and lower sides 2*b* and the auxiliary vanes are supported by the supporting columns 3*a* with their concave surfaces facing against a rotating direction of the rotary shaft 1.

With such an arrangement as described above, as the auxiliary vanes 3 are rotated together with the flat plates 2 during rotation of the rotary shaft 1, the gas-liquid flow reaches to the rear portions of the flat plates 2 by flows $F_1$, passing through the clearance (t) between the side edges of the flat plates 2 and the auxiliary vanes 3, and flows $F_2$ passing outward portions of the auxiliary vanes 3 as shown in FIG. 3.

The flows $F_1$ are thus regulated by the curved inner surfaces of the auxiliary vanes 3. Even if the eddy flows are generated at the rear portions of the side edges of the flat plates 2 by the auxiliary vanes 3, an occurrence of such eddy flows is reduced, their shearing force is weakened, a peeled-off eddy flow is reduced, and microorganisms are not damaged and the gas-liquid is agitated.

Figure 4:
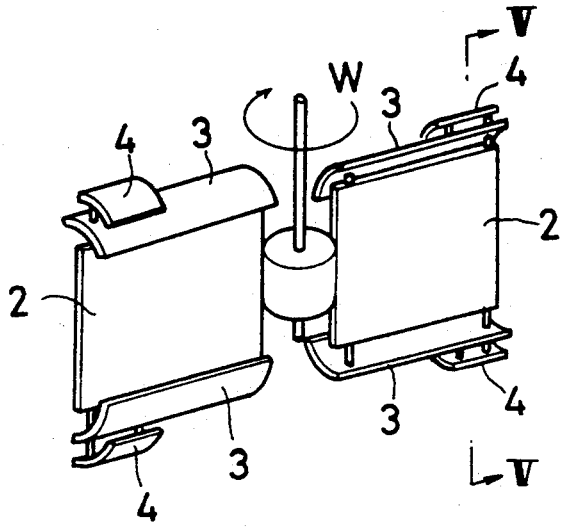
FIG. 4 is a perspective view showing the second preferred embodiment of the present invention.
Figure 5:
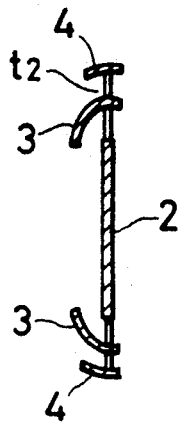
FIG. 5 is a sectional view taken along a line V—V of FIG. 4.

FIGS. 4 and 5 illustrate the second preferred embodiment, of the present invention, wherein small auxiliary vanes 4 are provided with clearances ($t_2$) outwardly of the auxiliary vanes 3. Thus, it becomes possible to reduce the peeled-off eddy flows being generated at the rear surfaces of end portions of the auxiliary vanes 3 and so the agitation of the gas-liquid is efficiently carried out.

Figure 6:
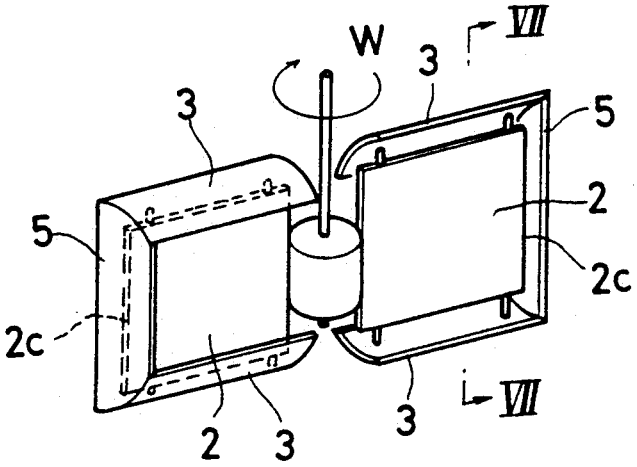
FIG. 6 is a perspective view showing the third preferred embodiment of the present invention.
Figure 7:
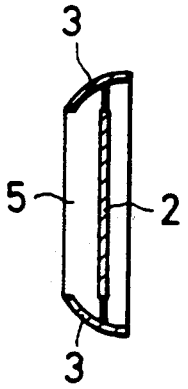
FIG. 7 is a sectional view taken along a line VII—VII of FIG. 6.
Figure 8:
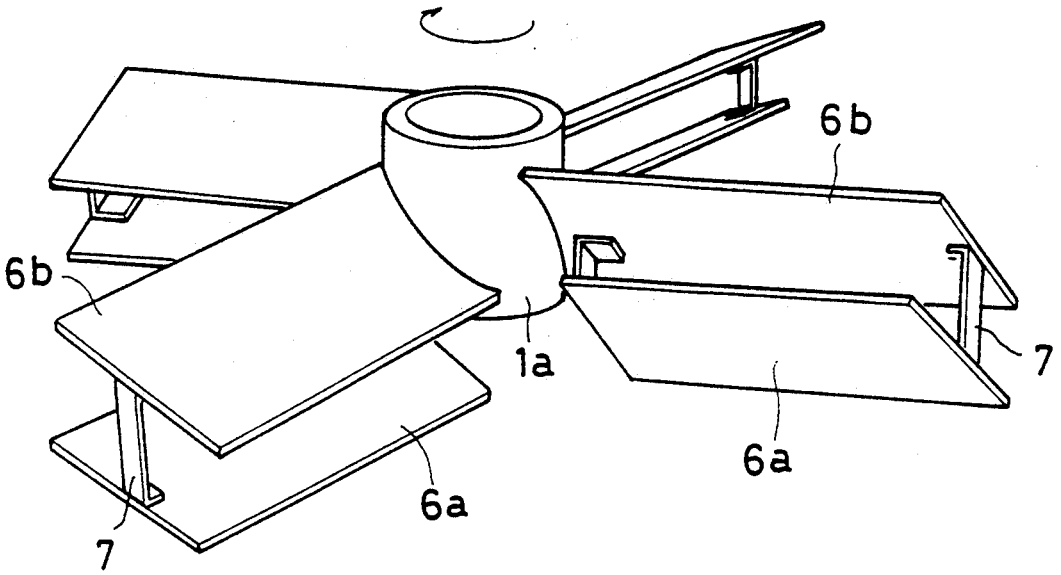
Figure 9:
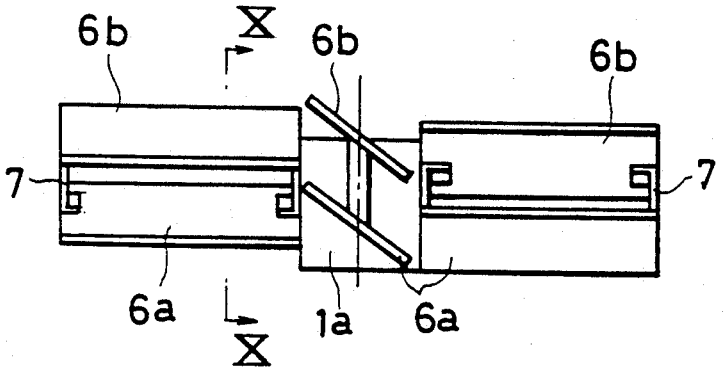
Figure 10:
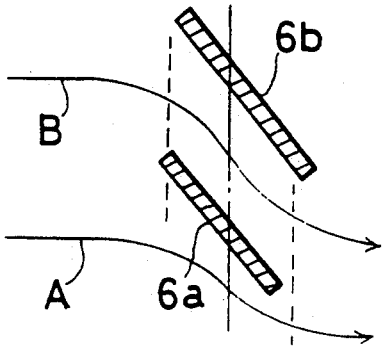
Figure 11:
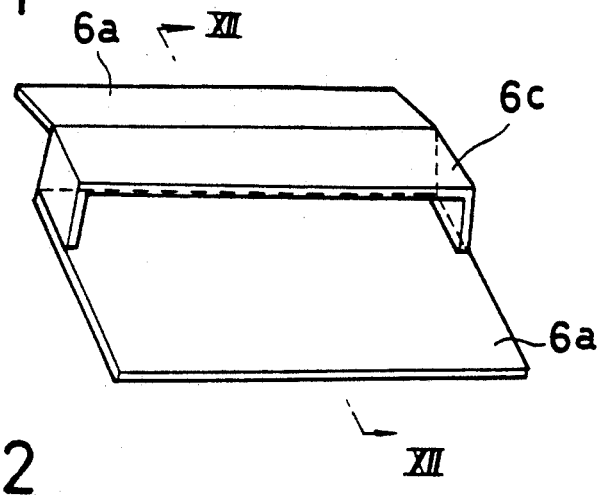
Figure 12:
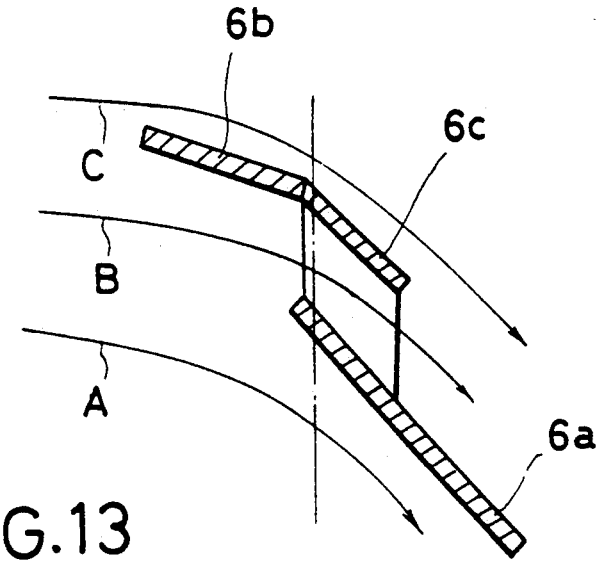
Figure 13:
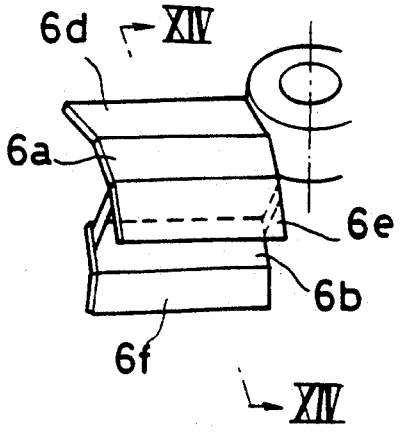
Figure 14:
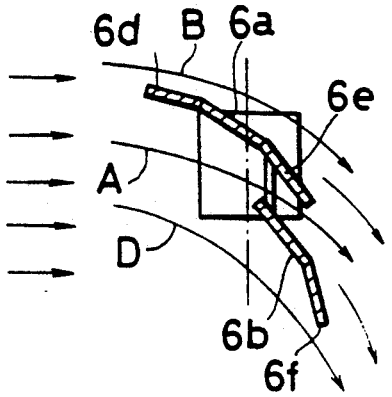
Figure 15:
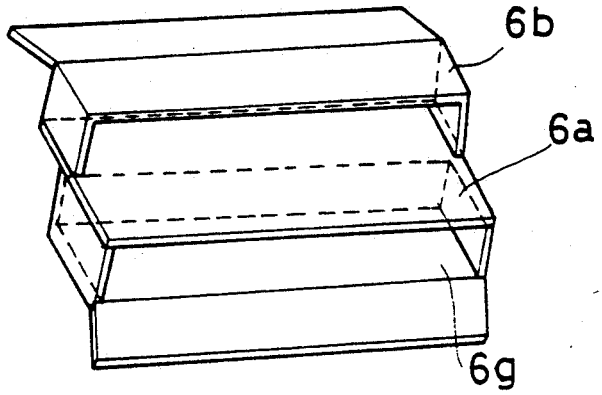
Figure 16:
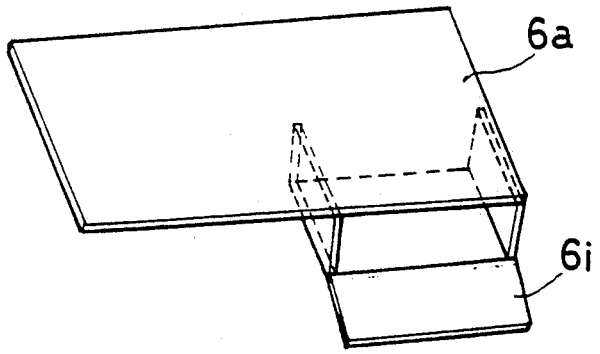
Figure 17:
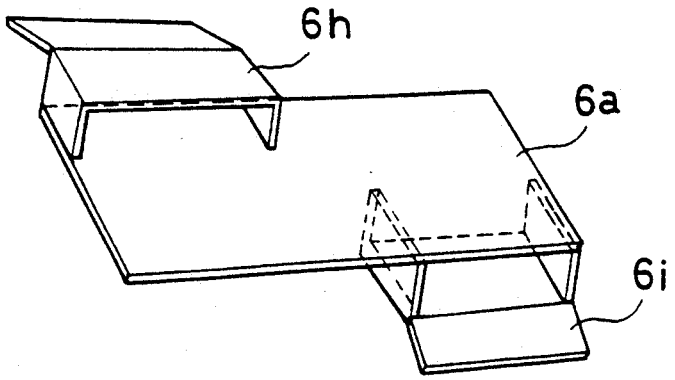
Figure 1:
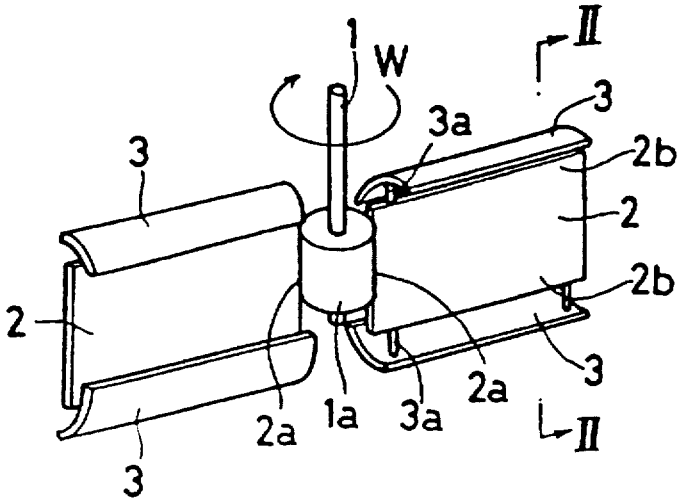
Figure 2:
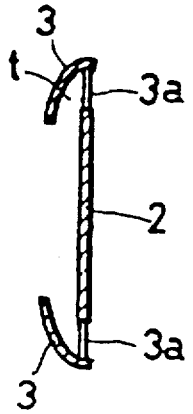
Figure 3:
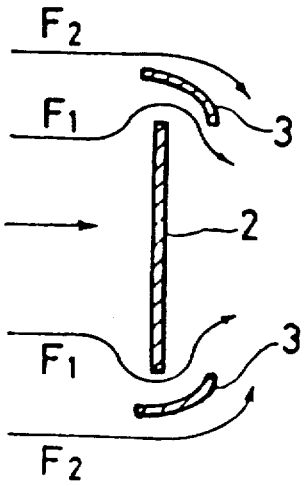
Figure 4:
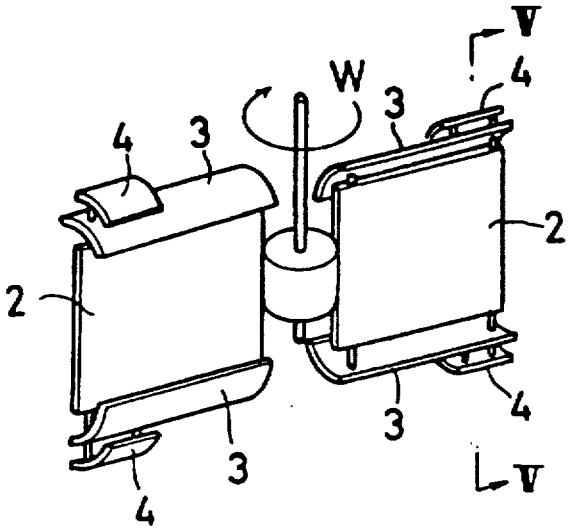
Figure 5:
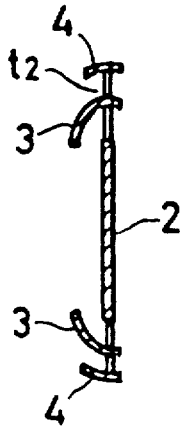
Figure 6:
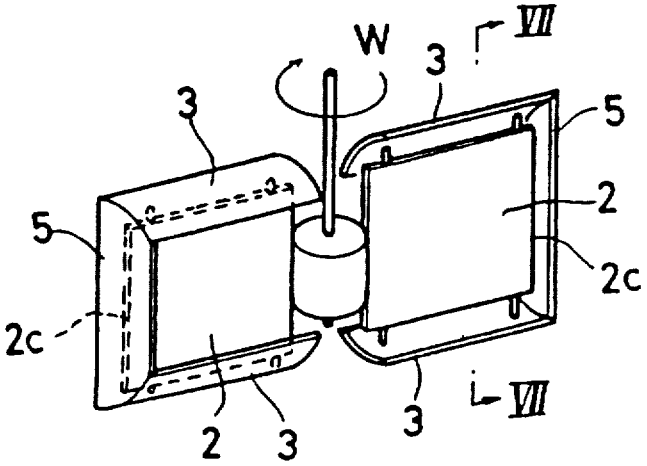
Figure 7:
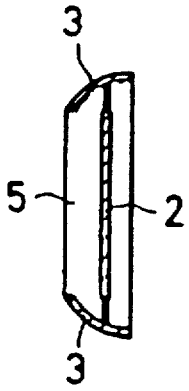

FIGS. 6 and 7 illustrate the third preferred embodiment of the present invention in which the outer sides 2*c* of the flat plates 2 have auxiliary vanes 5. Accordingly, the present invention has an effect that the eddy flows generated at all vane edges of the flat plates 2, are reduced, the peeled-off eddy flows are reduced and gas-liquid agitation is promoted.

In addition, the shape and arrangement of the auxiliary vanes 3 or the like can be optionally changed.

Obviously, numerous modifications and variations of the present invention are possible in light of the above teachings. It is therefore to be understood that within the scope of the appended claims, the invention may be practiced otherwise than as specifically described herein.

What is claimed is:

1. An agitating vane comprising:

a hub rotatable in a direction of rotation about an axis;

a plurality of flat plates laterally disposed at an outer circumference of the hub such that a major surface of each of said flat plates extends substantially perpendicular to said direction of rotation; and auxiliary vanes disposed at side edges of each of said flat plates and in parallel therewith such that spaces are left between said flat plates and said auxiliary vanes.

2. An agitating vane according to claim 1, wherein said auxiliary vanes each have a substantially arcuate section with concave surfaces facing upstream in a rotational direction of said flat plates.

3. An agitating vane according to claim 2, including further ones of said auxiliary vanes disposed at outer edges of said flat plates and parallel thereto, wherein a spacing is left between said outer edges and said auxiliary vanes.

4. An agitating vane according to claim 2, including small auxiliary vanes having the same shape as said auxiliary vanes and positioned spaced apart from said auxiliary vanes.

* * * * *

UNITED STATES PATENT AND TRADEMARK OFFICE

CERTIFICATE OF CORRECTION

PATENT NO. : 5,277,550

DATED : January 11, 1994

INVENTOR(S) : Kohichi KATO, et al.

It is certified that error appears in the above-indentified patent and that said Letters Patent is hereby corrected as shown below:

On the title page, Item [54] and Column 1, Line 1, change title to read:

--Agitating Vanes Having Auxiliary Vanes--

On the title page, after the Abstract, "5 Drawing Sheets" should be changed to --2 Drawing Sheets--.

Delete drawing Figures 8-17 as found on Sheet 3 of 5, 4 of 5 and 5 of 5 in their entirety. The drawings should consist of Figures 1-7 as found on Sheet 1 of 2 and 2 of 2 as shown on the attached pages.

Signed and Sealed this

Twenty-sixth Day of July, 1994

*Attest:*

Bruce Lehman

BRUCE LEHMAN

*Attesting Officer*

*Commissioner of Patents and Trademarks*